United States Patent [19]

Denney

[11] 4,176,534

[45] Dec. 4, 1979

[54] COMBINED CLIP AND QUICK RELEASE KEY

[76] Inventor: Jon F. Denney, 4443 Driftwood Pl., Boulder, Colo. 80301

[21] Appl. No.: 927,121

[22] Filed: Jul. 21, 1978

[51] Int. Cl.[2] ..... E05B 19/04

[52] U.S. Cl. ..... 70/408; 70/459

[58] Field of Search ..... 70/408, 456 R, 457, 70/458, 459, 19; 150/40; 24/3 K

[56] References Cited

U.S. PATENT DOCUMENTS

| | | | |
|---|---|---|---|
| 1,852,950 | 4/1932 | Amnheim | 70/408 |

FOREIGN PATENT DOCUMENTS

| | | | |
|---|---|---|---|
| 304491 | 7/1917 | Fed. Rep. of Germany | 70/408 |
| 197804 | 3/1978 | France | 70/408 |
| 488575 | 12/1953 | Italy | 70/408 |

*Primary Examiner*—Robert L. Wolfe

*Attorney, Agent, or Firm*—Donald W. Margolis

[57] ABSTRACT

A key for a lock wherein a resiliently deformable bow portion of the key is extended to form a loop of the split ring variety. The said split ring loop allows the release from and attachment of the key to a keyholder. The split ring loop is also adapted for use as a clip to hold or clamp items or to secure the key to various items other than keyholders.

9 Claims, 8 Drawing Figures

COMBINED CLIP AND QUICK RELEASE KEY

BACKGROUND OF THE INVENTION

1. Field of the Invention

The present invention relates to an operating mechanism or element for a lock in the form of a key. More particularly, it relates to a key having a bow or head which combines utility for use as a clip and for quick release and attachment to a keyholder or other article.

2. Prior Art

While there are a great variety of key designs and configurations, traditional usage has resulted in a relatively common form of stylized key, varying only slightly in size and width, according to the lock to which it is to be mated.

The most common form of key consists of a shank which supports a bit blank. The bit blank is normally formed into a distinctive pattern to operate the tumblers of a specific lock. Traditional keys also include a bow attached to one end of the shank, the bow being an enlarged portion for ease of handling and manipulating the key. Such bows are normally of continuous or one piece construction and form a centrally open loop or carry a hole. The commonly intended function of the open loop or hole in the bow is to receive a keyholder of one form or another.

There are a large variety of different types of keyholders which allow, with varying degrees of ease, the mounting and removal of keys, while at the same time providing means for securely carrying one or more keys. Such keyholders have taken many forms, but commonly include either a loop, hook, chain, ring, tether or other means designed to be inserted into the loop or hole in the bow of the key.

It is frequently necessary to release a key from or attach a key to a keyholder in an operation which may be troublesome, annoying, and time consuming. Such needs for removal and reattachment arise, for example, where a single keyholder includes a variety of keys for different uses, for example, house keys, business keys, and automobile ignition and trunk keys. Thus, for example, when a car is left with a parking attendant, it may be necessary to leave the ignition key, but may not be desirable to leave other keys, such as the keys to the trunk of the car and/or keys to home and business with the attendant. In other instances it may be necessary for a home or business key to be passed to another individual. Other instances requiring key removal may exist. In each of these circumstances it is necessary to manipulate the key and keyholder, often with some amount of trouble and annoyance to remove the key from its keyholder. This can be especially annoying, for example, when a car key is being passed to a parking attendant, as it normally requires that the ignition, and thus, the motor, be turned off, removal of the key from the ignition, removal of the ignition key from the key ring by whatever mechanism is provided by the keyholder, replacement of the key in the ignition and restarting of the motor.

In the prior art, some forms of key have been provided in which the normal bow portion of the key is open or capable of being opened to allow release of the key from a keyholder. See for example, U.S. Pat. Nos. 470,997; 1,852,950; and 3,481,169. There also exists in the art attachments to a key, which attachments are secured to a keyholder, and from which attachments a key can be released or attached, see for example U.S. Pat. Nos. 3,349,589 and 3,797,291. A large variety of quick-release type keyholders have also been provided in the prior art.

On occasion, a key user may, due to professional or personal reasons, find themself in need of a small clamp. Such need may arise from such diverse needs as a desire or need to hold for examination, for example, a small piece of mineral, plant matter, or an insect, without actually touching the item. In other instances, it may be desirable to have a clip for holding a mechanical element, such as a screw, nail, or a to-be-glued or attached element adjacent to a work surface. Where habit or desire control, a clamp for holding a cigar or cigarette may be needed by a smoker.

In some instances it may be desired to place a key in a location for storage. No known key is functionally designed to allow easy and secure storage or attachment to any random article for storage.

Clamps of many kinds, including clamps for cigars and cigarettes have long been known in the art, and are represented, for example, by U.S. Design Pat. No. 11,877 and U.S. Pat. Nos. 1,840,255 and 2,042,891. However, such clips or holders are normally limited to serve the sole function of being a clip or holder. There does exist in the prior art a novelty item represented by U.S. Design Pat. No. 242,931, nominally in the form of a key, which is capable of having its bow portion deformed to cause a scissors-like action in the shank of the key so that the shank opens to serve as a cigar or cigarette holder. However, such an item is primarily a novelty clip, and may not be reliably functional as a key, as the split in the shank may so weaken the shank that its use in a lock tumbler will cause distortion, bending, or breaking of the key. Nowhere in the prior art is there known to be a device wherein the bow of a key attached to a normally solid useful key shank has a deformable portion to both allow the key to be quickly released and attached to a keyholder and to manipulate an extension which can be utilized as a clip or storage holder.

SUMMARY OF THE INVENTION

The present invention relates to a key which is quickly and easily releasable from and attachable to a key carrier. It also relates to the same device which is usable as a clip, clamp or storage holder. These results are achieved by utilizing a key having a resiliently deformable bow, wherein extensions of the bow form a split ring loop. Deformation of the bow causes the split ring loop to open allowing positioning and removal of the key from a key holder. The device also provides utility as a clip or clamp in that manipulation of the bow can cause the split ring to be opened and then closed on to an object which is to be held or clamped, or on which the key is to be stored. The shape of the bow and its extensions are nominally that of a figure "8". The two portions which form the bow and its extensions are nominally in the shape of an "S" and a reverse "S".

In preferred embodiments, the device includes a solid shank which has actual utility as a key. However, in some equivalent modifications the shank may be caused to split or open in a scissors-like action in reaction to the same deformation of the bow which causes the split ring to open.

As used herein the term "keyholder" includes all conventional keyholders, including, but not limited to, annular rings, chains, hooks, tethers or any other device designed to carry and store keys by passing through the opening or hole in the bow of a key. It should also be noted that while one form of key is shown, the present invention is not limited to that type, size or shape of key, but rather, applies to all types of keys which include a bow or head portion. In a similar manner, while the key shown is of the type normally utilized with a cylinder-type lock, it should be understood that the present invention is applicable to any key including a bow or head portion.

Furthermore, utility of this device as a quick release key is not its sole utility, but rather the device is fully usable as a clip or clamp for holding items or securing the key to almost any article.

BRIEF DESCRIPTION OF THE DRAWINGS

The various objects and features of the present invention will be more fully understood from the following detailed description of preferred embodiments and applications thereof, throughout which description reference is made to the accompanying drawings, in which.

DESCRIPTION OF THE PREFERRED EMBODIMENTS

Figure 1:
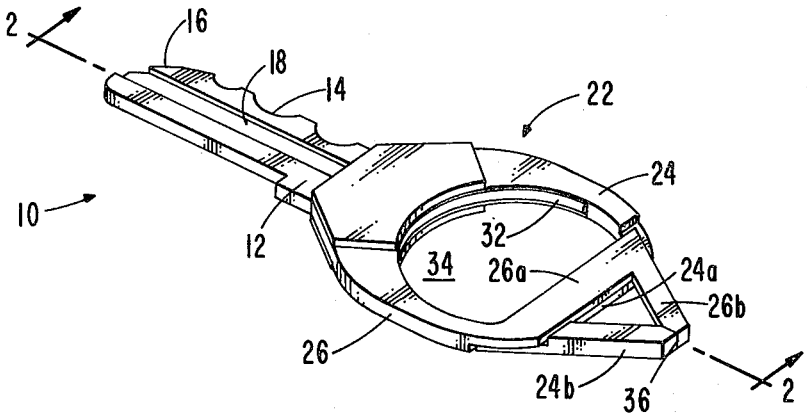
FIG. 1 is a perspective view of the combined clip and quick-release key of the present invention.
Figure 2:
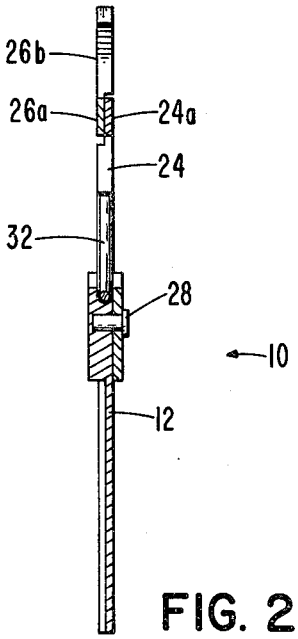
FIG. 2 is a sectional view taken as indicated by lines 2—2 on FIG. 1.

The present invention is capable of being incorporated into a wide variety of key shapes, each generally characterized by a shank, a bit, a bow, and extensions from the bow, wherein the bow and its extensions are generally in the shape of a figure "8", and the individual components of the bow and its extensions are nominally in the form of an "S" and a reverse "S". Referring to FIGS. 1 through 4, there is shown a device 10 of the present invention wherein a clip and quick-release key are combined. Device 10 includes a shank portion 12. One or more margins of shank 10 are profiled to define bit 14 having the proper tumbler activating combination for the lock mechanism which it actuates. As with most traditional keys, this device includes tapered nose 16 to facilitate entry of the key into a lock and a flute 18 formed in the shank to establish the cross-sectional configuration of the key which allows it to enter only properly sized and mated locks. Other than being in combination with bow 22 the shape, configuration, size and type of bit and shank is of little or no consequence to the present invention. Bow 22 is an enlarged generally flat member attached to and generally in the plane of shank 12. Its size and shape lend themselves to manipulation, for example, by the thumb and fingers of a persons hand, in both its traditional use as a key and for the modified clamping uses taught herein.

Bow 22 is formed of bow portion 24 and 24*a* and bow portion extension 24*b* and bow portion 26 and 26*a* and bow portion extension 26*b*. Bow portion 24, 24*a* and its extension 24*b* and bow portion 26, 26*a* and its extension 26*b* nominally are in the form of a letter "S" and a reverse "S". In the embodiment shown connecting portions 24*a* and 26*a* are shaped and designed to have a lesser thickness than bow portions 24, 24*b*, 26 and 26*b*. This allows the bow portions and their extensions to combine in a manner which allows them to slide past one another without having increased thickness at this portion of the device.

In the embodiment shown, both bow portions 24 and 26 are pivotally connected to shank 12 by means of connecting pivot 28. This allows both bow portion 24 and bow portion 26 to pivot relative to shank 12. The inner edge of bow portion 24 and bow portion 26 have been modified to receive and hold spring element 32. Spring element 32 is designed and positioned to normally urge bow portions 24 and 26 away from one another to define the largest possible annular opening 34 which the bow portions are normally capable of assuming. However, spring 32 is of such strength and resiliency that opposed inward pressure on the outer surfaces of either or both bow portions 24 and 26 causes spring 32 to yield so that bow portions 24 and 26 move towards one another and reduce the size of annular opening 34.

Bow extensions 24*b* and 26*b* come together at split 36. In this embodiment they are located at the portion of the bow opposed to the location of shank 12. Split 36 is normally closed.

Figure 3:
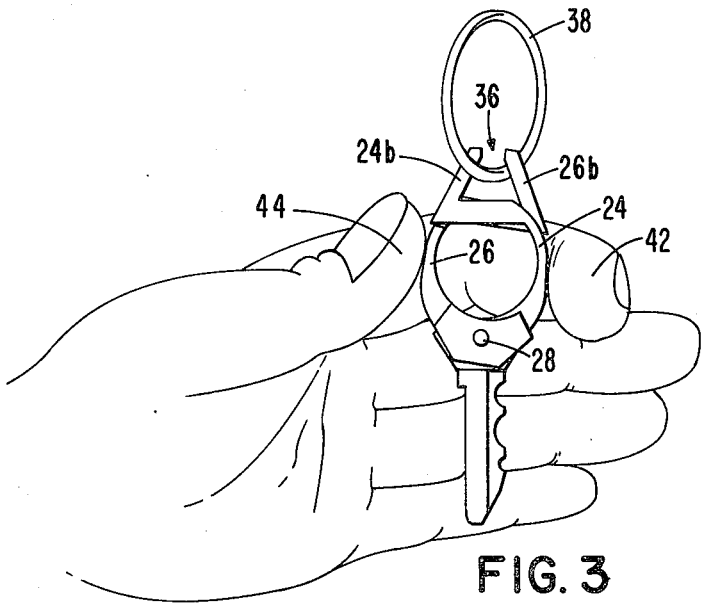
FIG. 3 is a perspective view showing one form of the present invention being attached to or released from a keyholder.

In operation, when it is desired to utilize the device of the present invention to attach or release a key from a keyholder 38 it is utilized as shown in FIG. 3. Bow portions 24 and 26 are positioned respectively, for example, at the index finger 42 and thumb 44 of the user. Manual force bringing index finger 42 and thumb 44 together overcomes the outward push of spring 22 and causes bow portions 24 and 26 to move towards one another, thus reducing the size of the annular opening defined by those bow portions. This movement in turn causes extensions 24*b* and 26*b* to move away from one another at split portion 36. When sufficient movement is achieved so that split 36 is wider than the width of keyholder 38 to which it is being attached or from which it is being released, then the user can slip the device of the present invention off-of or on-to keyholder 38. After the key is removed from or attached to keyholder 38, release of pressure on bow portions 24 and 26 will allow spring 32 to cause split 36 to resiliently come together and stay together and return the key to its normal configuration, either off-of the keyholder or locked-on to the keyholder.

Figure 4:
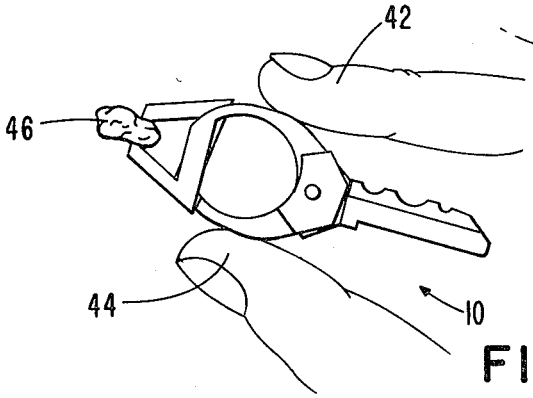
FIG. 4 is a perspective view showing one form of the device of the present invention being utilized as a clip or clamp.

When it is desired to utilize the device of the present invention as a clip, as shown in FIG. 4, or to secure the key to an article, it is manipulated in much the same manner as it is manipulated when it is placed on-to or removed from a keyholder. However, after bow portions 24 and 26 are squeezed together, extensions 24*b* and 26*b* defining split 36 are manipulated to surround the object to be grasped, such as stone 46. Then when lateral inward pressure is removed from bow portions 24 and 26 they return to their normal position causing extensions 24*b* and 26*b* to come together to clip or clamp stone 46.

Figure 5:
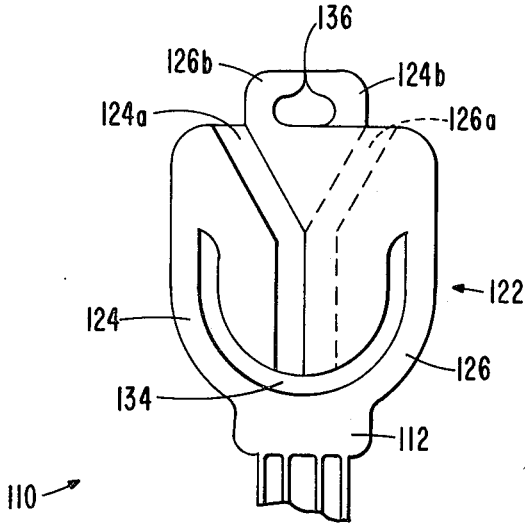
FIGS. 5 and 6 show a portion of one modified form of the present invention in closed and opened configuration, respectively.
Figure 6:
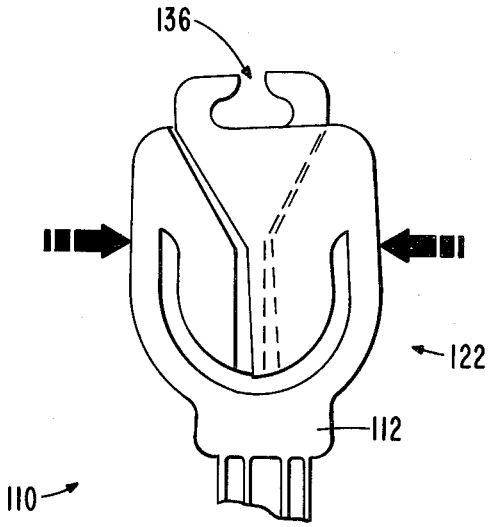

Many modifications of the present invention are possible without departing from the spirit and scope of the present invention. For example, referring to FIGS. 5 and 6, one modified embodiment of the present invention is shown. In this modification only the top of the shank, the bow, and the bow extensions are shown. The portions of the device are generally numbered the same as the corresponding portions of the devices shown in FIGS. 1-4, with the exception that they are increased by "100."

In this form of the invention key 110 includes a shank portion 112. Bow 122 attached to and generally in the plane of shank 112 is of a size and shape which lends itself to use as a portion of both a key and a clip. Bow 122 and its extension is formed of bow portion 124 and 124*a* and bow portion extension 124*b* and bow portion 126 and 126*a* (shown in phantom) and bow portion extension 126*b*. Bow portions 124*a* and 126*a* are of lesser thickness than bow portion 124, 124*b*, 126 and 126*b*, thus allowing the bow portions to slide past one another when they are compressed. Bow portions 124, 124*a*, 126 and 126*a* define annular opening 134. The resiliency and thickness of bow portions 124 and 126 in the vicinity of their connection to shank 112 is such that opposed inward pressure on the outer surfaces of either or both bow portions 124 and 126 causes bow portions 124 and 126 to move towards one another in the thin areas defined by 124*a* and 126*a*.

In this embodiment, bow extensions 124*b* and 126*b* come together at split 136. However, when bow portions 124 and 126 are moved towards one another by lateral inward pressure as shown by the arrows in FIG. 6, bow extensions 124*b* and 126*b* move away from one another at split 136. When lateral inward pressure is removed from bow portions 124 and 126 they return to their normal position, shown by FIG. 5, thus causing extensions 124*b* and 126*b* to again come together at split 136.

Figure 7:
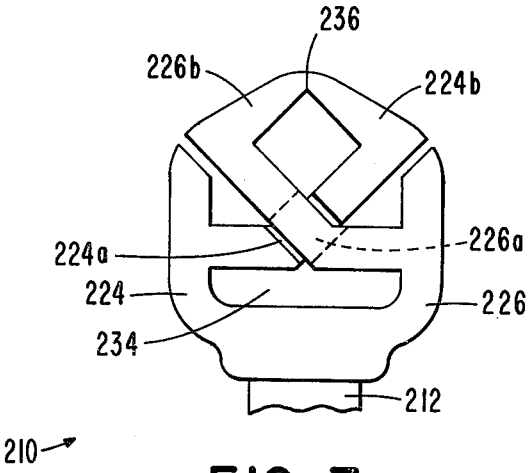
FIGS. 7 and 8 show a portion of yet another form of the present invention in closed and opened configuration, respectively.
Figure 8:
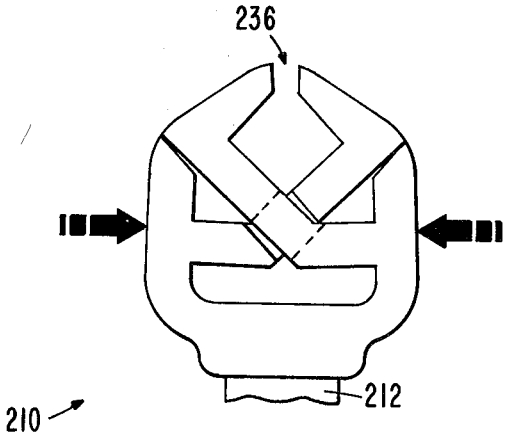

Referring to FIGS. 7 and 8, yet another modified embodiment of the present invention is shown. The portions of the device are again generally numbered the same as the corresponding portions of the devices shown in FIGS. 1-4, with the exception that, in this example, they are increased by "200."

In this form of the invention key 210 includes a shank portion 212. Bow 222 attached to and generally in the plane of shank 212 lends itself to use as a portion of both a key and a clip. Bow 222 is formed of bow portion 224 and 224*a* and bow portion extension 224*b* and bow portion 226 and 226*a* (shown in phantom) and bow portion extension 226*b*. Bow portions 224*a* and 226*a* are of lesser thickness than bow portion 224, 224*b*, 226 and 226*b*, thus allowing the bow portions to slide past one another. Bow portions 224, 224*a*, 226 and 226*a* define annular opening 234. The resiliency and thickness of bow portions 224 and 226 in the vicinity of their connection to shank 212 is such that opposed inward pressure on the outer surfaces of either or both bow portions 224 and 226 causes bow portion 224 and 226 to move towards one another in the thin areas defined by 224*a* and 226*a*.

In this embodiment, bow extensions 224*b* and 226*b* come together at split 236. However, when bow portions 224 and 226 are moved towards one another bow extensions 224*b* and 226*b* move away from one another at split 226, as shown in FIG. 8. When lateral inward pressure is removed from bow portions 224 and 226 they return to their normal position, shown by the arrows in FIG. 7, thus causing extensions 224*b* and 226*b* to again come together at split 236.

While preferred embodiments of the present invention have been shown, it will be clear to one skilled in the art, that other modifications and changes can be made without departing from the spirit and scope of the present invention. For example,

What is claimed is:

1. A combined clip and key for quick release or attachment to a keyholder including in combination:

a shank portion;

a bit portion shaped or shapable for operating a lock, said bit portion carried by said shank; and a bow for handling said key, said bow secured to said shank; wherein the improvement comprises, in combination:

said bow formed of a first bow portion and a second bow portion, both said first and second bow portions secured to said shank and located in substantially the same plane as said shank, said portions normally defining a first annular opening, at least one of said bow portions being resiliently movable with respect to said shank and independently moveable of said other bow portion; and a first bow extension connected to said first bow portion, and a second bow extension connected to said second bow portion, said bow extensions forming a normally closed split ring loop defining a second annular opening, whereby movement of at least one bow portion causes said normally closed split ring loop to split open for use as a clip or for release or attachment to a keyholder.

2. The device of claim 1 wherein said loop formed by said extensions of said bow portions are substantially in the plane of the bow and wherein the bow and the loop, in combination, form a nominal figure "8."

3. The device of claim 2 wherein one of said bow portions and its extension forms a letter "S" and the other of said bow portions and its extension form a reverse letter "S."

4. The device of claim 1 wherein both bow portions are resiliently moveable with respect to said shank.

5. The device of claim 1 where at least one bow portion is pivotally connected to said shank.

6. The device of claim 5 wherein resilient means are located within said bow in contact with at least one of said bow portions to normally urge said one bow portion away from said other bow portion, to simultaneously urge said first annular opening open, and to urge said split ring loop closed.

7. The device of claim 5 wherein said resilient means are in contact with both of said bow portions.

8. The device of claim 1 wherein both bow portions are pivotally connected to said shank.

9. A combined clip and key for quick release or attachment to a keyholder including in combination:

a. A shank portion;

b. A bit portion shaped or shapable for operating a lock, said bit portion extending from said shank;

c. A bow for handling said key, said bow secured to said shank, wherein the improvement comprises, in combination:

a bow comprising a first portion and a second portion forming a first annular opening, said first and second bow portions each having extensions substantially opposed to said shank, said extensions returned upon themselves to form a ring in substantially the same plane as said bow, said ring being provided with a normally closed slit, whereby the slit may be opened for use as a clip or for release or attachment of the key to a keyholder.

* * * * *